US007175312B2

(12) United States Patent
Fowler, Jr.

(10) Patent No.: US 7,175,312 B2
(45) Date of Patent: Feb. 13, 2007

(54) FLUORESCENT WALL WASH LUMINAIRE WITH ADJUSTABLE LAMP AUTOMATICALLY DETENTED IN POSITION BY A SPRING LATCH

(75) Inventor: Wilton LeGrand Fowler, Jr., Veradale, WA (US)

(73) Assignee: Hubbell Incorporated, Orange, CT (US)

( * ) Notice: Subject to any disclaimer, the term of this patent is extended or adjusted under 35 U.S.C. 154(b) by 45 days.

(21) Appl. No.: 11/068,474

(22) Filed: Mar. 1, 2005

(65) Prior Publication Data

US 2006/0198135 A1 Sep. 7, 2006

(51) Int. Cl.
*F21V 23/02* (2006.01)
*F21V 17/02* (2006.01)

(52) U.S. Cl. ..... 362/260; 362/282

(58) Field of Classification Search ..... 362/362, 362/260, 225, 220, 296–298, 279, 282, 320, 362/322, 323, 287, 427, 428, 285
See application file for complete search history.

(56) References Cited

U.S. PATENT DOCUMENTS

| | | | | |
|---|---|---|---|---|
| 2,740,885 | A | 4/1956 | Kruger | |
| 3,299,263 | A | 1/1967 | Bjontegard | |
| 4,164,009 | A | 8/1979 | Maguire, Jr. et al. | |
| 4,419,717 | A | 12/1983 | Price et al. | |
| 4,497,014 | A | 1/1985 | Woloski et al. | |
| 4,739,454 | A | 4/1988 | Federgreen | |
| 4,779,178 | A | 10/1988 | Spitz | |
| 4,811,177 | A | 3/1989 | Lauckhardt et al. | |
| 4,933,824 | A * | 6/1990 | Tait et al. | 362/362 |
| 5,550,725 | A | 8/1996 | Shemitz et al. | |
| 5,564,815 | A | 10/1996 | Littman et al. | |
| 5,655,833 | A | 8/1997 | Raczynski | |
| 5,803,585 | A | 9/1998 | Littman et al. | |
| 6,079,851 | A * | 6/2000 | Altman et al. | 362/260 |
| 6,092,913 | A * | 7/2000 | Edwards, Jr. | 362/260 |
| 6,102,550 | A * | 8/2000 | Edwards, Jr. | 362/221 |
| 6,109,766 | A | 8/2000 | Baliozian | |
| 6,123,432 | A * | 9/2000 | Feng | 362/147 |
| 6,425,681 | B1 * | 7/2002 | Agabekov | 362/375 |

(Continued)

FOREIGN PATENT DOCUMENTS

| | | | |
|---|---|---|---|
| JP | 05012909 | A | 1/1993 |

*Primary Examiner*—Renee Luebke
*Assistant Examiner*—Julie A Shallenberger
(74) *Attorney, Agent, or Firm*—Alfred N. Goodman; Mark S. Bicks; Michael E. Stimson

(57) ABSTRACT

A fluorescent wall wash luminaire has a housing with an opening for light generated by a fluorescent lamp to exit the housing. A portion of the housing forms an inclined base, and a socket pan holding a lamp socket for the fluorescent lamp is slidably mounted on the inclined base. The position of the socket pan may be adjusted by sliding the socket pan along the inclined base between an upper position and a lower position. The socket pan is held in place by a latching plate mechanism formed by a latching plate and a latching spring. The latching mechanism holds the socket pan in the upper position, the lower position, and selected positions between the upper and lower position. The amount and distribution of light emitted by the luminaire varies depending on the position of the lamp along the inclined base, thereby providing the ability to adjust the distribution of emitted light.

27 Claims, 5 Drawing Sheets

U.S. PATENT DOCUMENTS 6,431,726 B1 8/2002 Barton
6,450,668 B1 9/2002 Kotloff
6,517,216 B1 2/2003 Cercone et al.
6,523,975 B1 * 2/2003 Plourde et al. ..... 362/225
6,652,118 B2 11/2003 Shemitz et al.
2003/0026091 A1 * 2/2003 Shemitz et al. ..... 362/125
2005/0041432 A1 * 2/2005 McCarthy et al. ..... 362/362
2005/0243547 A1 * 11/2005 Cini et al. ..... 362/219

* cited by examiner

FLUORESCENT WALL WASH LUMINAIRE WITH ADJUSTABLE LAMP AUTOMATICALLY DETENTED IN POSITION BY A SPRING LATCH

CROSS-REFERENCE TO RELATED APPLICATIONS

This application is related to application Ser. No. 11/068,475, which is entitled Flourescent Luminaire With A Sliding Mechanism For Adjusting Lamp Position, filed concurrently herewith, and invented by the same inventor, W. LeGrand Fowler, Jr. That application is hereby incorporated by reference in its entirety.

FIELD OF THE INVENTION

The present invention generally relates to fluorescent luminaires. More specifically, the present invention relates to a fluorescent wall wash luminaire with a lamp that may be moved to adjust the light distribution pattern emitted by the luminaire.

BACKGROUND OF THE INVENTION

One type of fluorescent luminaire is a wall wash luminaire. A wall wash luminaire typically includes a ceiling mounted housing that is mounted adjacent a vertical surface such as a wall. Fluorescent lamps and a specular reflector are located within the housing. The housing and the reflector are configured so that the majority of the light emitted by the lamps is directed towards the wall. One example of a wall wash luminaire is the FW102 luminaire that is commercially available from Columbia Lighting of Spokane, Wash.

In order to provide an even amount of lighting on an illuminated wall surface, it is desirable that the light emitted from the luminaire is emitted in an asymmetric pattern. This allows more light to be directed towards the portions of the wall which are further away from the luminaire.

One disadvantage of most wall wash luminaires is that the reflectors and the lamps are in a fixed position, and the light emitted by the luminaire is therefore emitted in a fixed pattern. This means that the luminaire must be mounted in a precise position in order to evenly light a desired surface. Often, however, it is not possible to precisely position a luminaire due to mounting requirements.

In order to address this disadvantage, there have been attempts to provide adjustable luminaires. Examples of adjustable luminaires are disclosed in U.S. Pat. No. 6,652,118 B2 to Shemitz et al., U.S. Pat. No. 5,803,585 to Littman et al., and U.S. Pat. No. 5,564,815 to Littman et al., each of which is hereby incorporated herein by reference in its entirety. Although the adjustable features of those luminaires ease the disadvantages described above, a continuing need exists for an improved fluorescent wall wash luminaire.

SUMMARY OF THE INVENTION

One object of the present invention to provide a wall wash luminaire with an adjustable light distribution pattern.

Another object of the present invention is to provide a luminaire with a fluorescent lamp mounted on a movable base so that the lamp may be repositioned to adjust the light distribution pattern of the luminaire housing.

A further object of the present invention to provide a luminaire with a lamp which may be moved to adjust the pattern of light emitted by the luminaire.

The foregoing objects are basically attained by a fluorescent wall wash luminaire that has a housing with an opening for light generated by a fluorescent lamp to exit the housing. A portion of the housing forms an inclined base, and a socket pan holding a lamp socket for the fluorescent lamp is slidably mounted on the inclined base. The position of the socket pan may be adjusted by sliding the socket pan along the inclined base between an upper position and a lower position. The socket pan is held in place by a latching plate mechanism formed by a latching plate and a latching spring. The latching mechanism holds the socket pan in the upper position, the lower position, and selected positions between the upper and lower position. The amount and distribution of light emitted by the luminaire varies depending on the position of the lamp along the inclined base, thereby providing the ability to adjust the distribution of emitted light.

Other objects, advantages, and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure.

DETAILED DESCRIPTION OF THE INVENTION

Figure 1:
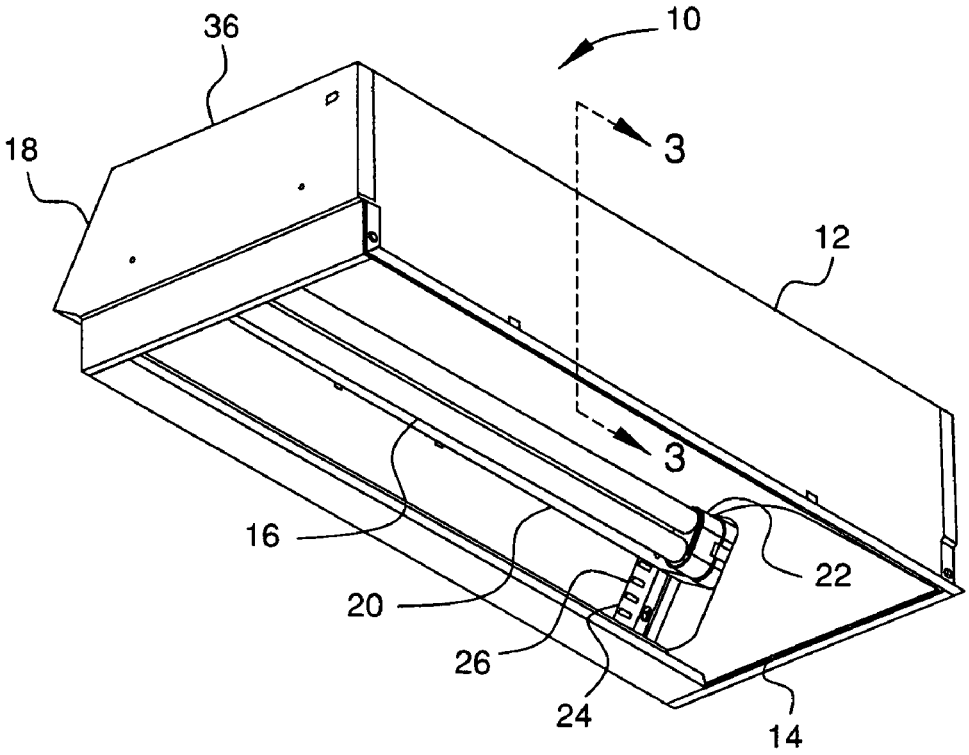
FIG. 1 is a perspective view of a luminaire according to an exemplary embodiment of the present invention with the socket pan located in an upper position.
Figure 2:
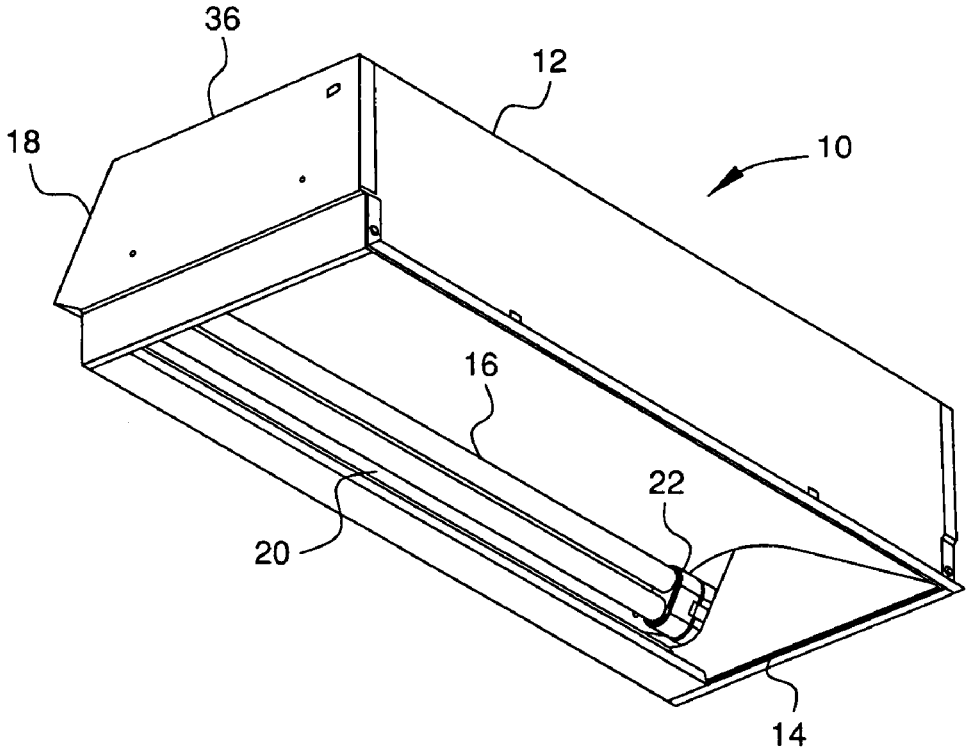
FIG. 2 is a perspective view of the luminaire of FIG. 1 with the socket pan located in a lower position.

Referring initially to FIGS. 1 and 2, the fluorescent wall wash luminaire 10 of the present invention has a housing 12 with an opening 14 for light generated by a fluorescent lamp 16 to exit the housing. A portion of the housing forms an inclined base 18. A socket pan 20 holding a lamp socket 22 for the fluorescent lamp 16 is slidably mounted on the inclined base 18. The position of the socket pan 20 may be adjusted by sliding the socket pan 20 along the inclined base 18 from an upper position, shown in FIG. 1, to a lower position, shown in FIG. 2. The socket pan 20 is held in place in various desired positions by a latching plate mechanism 24 formed by a latching plate 26 and a latching spring 28 (see FIGS. 6–9). The latching mechanism 24 can hold the socket pan 20 in the upper position, the lower position, and selected positions between the upper and lower position. The amount and distribution of light emitted by the luminaire varies depending on the position of the lamp along the inclined base 18, thereby providing the ability to adjust the distribution of light emitted from the luminaire.

Figure 3:
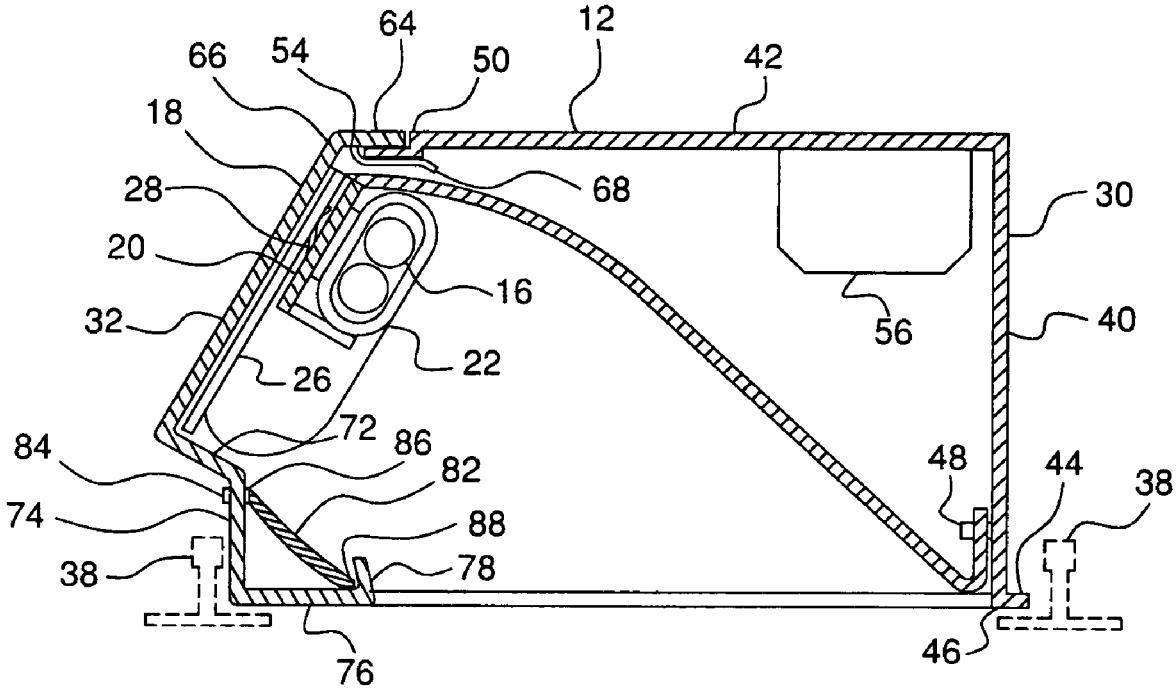
FIG. 3 is a side elevational view in cross-section taken along the lines 3—3 in FIG. 1.

The luminaire housing 12 is preferably constructed of die-formed, code-gauge, cold-rolled steel and, as best seen in FIGS. 1–5, is formed by a front housing portion 30, a back housing portion 32, a right end cap 34, and a left end cap 36. The luminaire housing 12 can be directly mounted to the surface of a supporting structure (such as a ceiling). Alternatively, as illustrated in FIG. 3, the fixture may be supported by a ceiling grid 38 (indicated in dashed lines).

The front housing portion 30 forms the front wall 40 and top wall 42 of the housing 12. The front wall 40 and top wall 42 are preferably at a substantially right angle to one another. A lip 44 on the bottom edge 46 of the front wall 40 strengthens the edge and provides locations for mounting the housing to a supporting structure. Two tabs 48 extend generally perpendicularly from the inside of the front wall. Preferably, the tabs are formed by punching the front wall of the housing to form the tab shape and folding the tab shape inward to form the tab. The back edge 50 of the top wall 42 is formed with an offset 52 so that it cooperates with the back wall 54 of the housing 12, as seen most clearly in FIG. 10.

Figure 4:
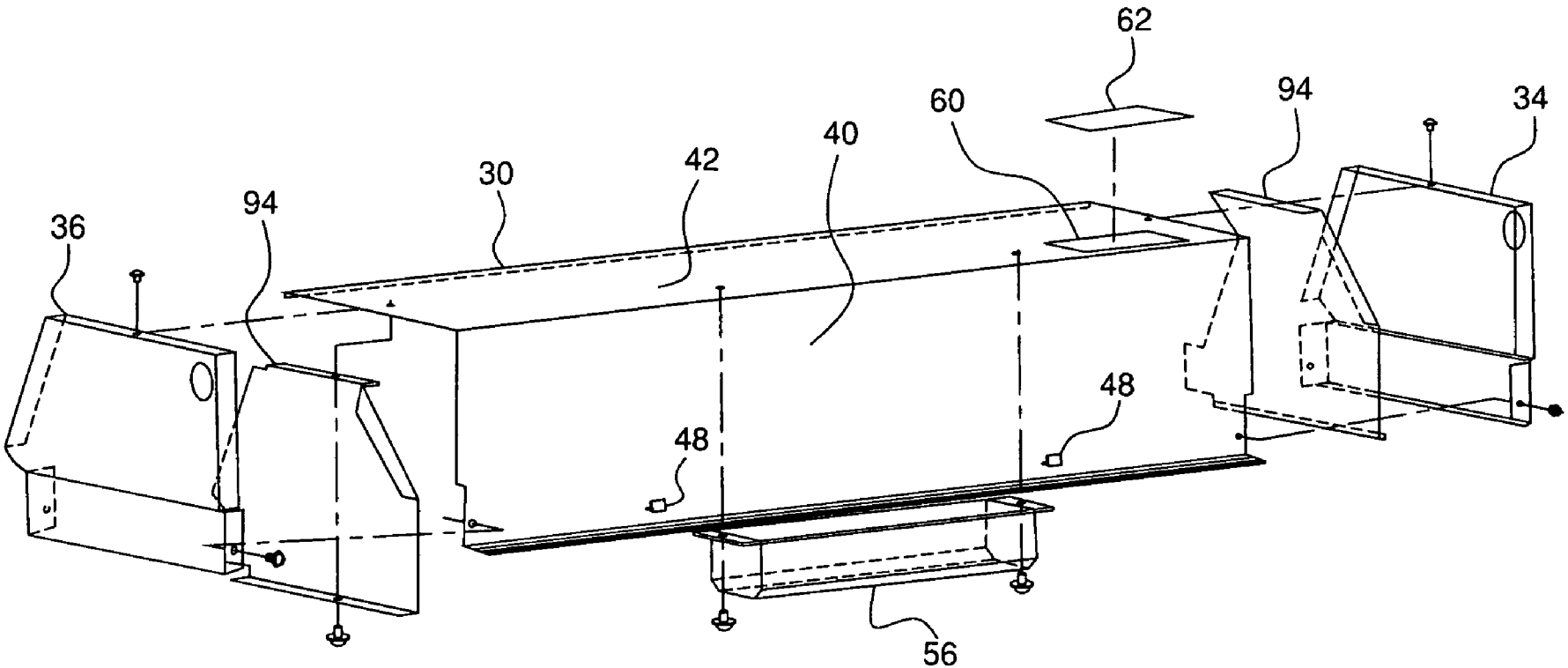
FIG. 4 is an exploded front elevational view of the front portion of the luminaire shown in FIG. 1.

Referring to FIG. 4, a ballast 56 is attached to the inside of the top wall 42 of the housing 12. The ballast is a conventional fluorescent lamp ballast and may be either electronic or magnetic as desired. Alternatively, several housings may be placed together in a master/slave arrangement with a single ballast located in the master fixture. An aperture 60 in the top wall 42 of the front housing portion 30 provides access to the ballast 56 and an access plate 62 covers the aperture 60 when not in use.

Figure 10:
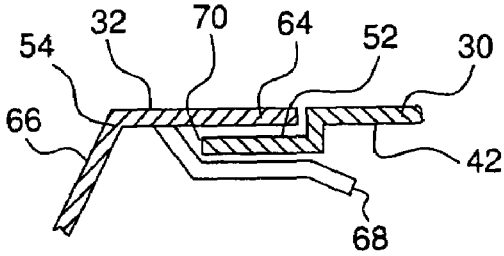
FIG. 10 is an enlarged, sectional view of a positioning flange.

Returning to FIG. 3, the back housing portion 32 forms an inclined base 18 that is approximately 30° from vertical. An upper lip 64 is located at the top edge 66 of the inclined base 18. Three flanges 68 are formed on the upper lip 64 and, as illustrated in FIG. 10, form a receiving groove 70. When the front housing portion 30 and back housing portion 32 are assembled, the offset edge 52 formed on the top wall 42 lies adjacent the upper lip 64 and is held in place within the receiving groove 70 formed by the three flanges 68.

Figure 5:
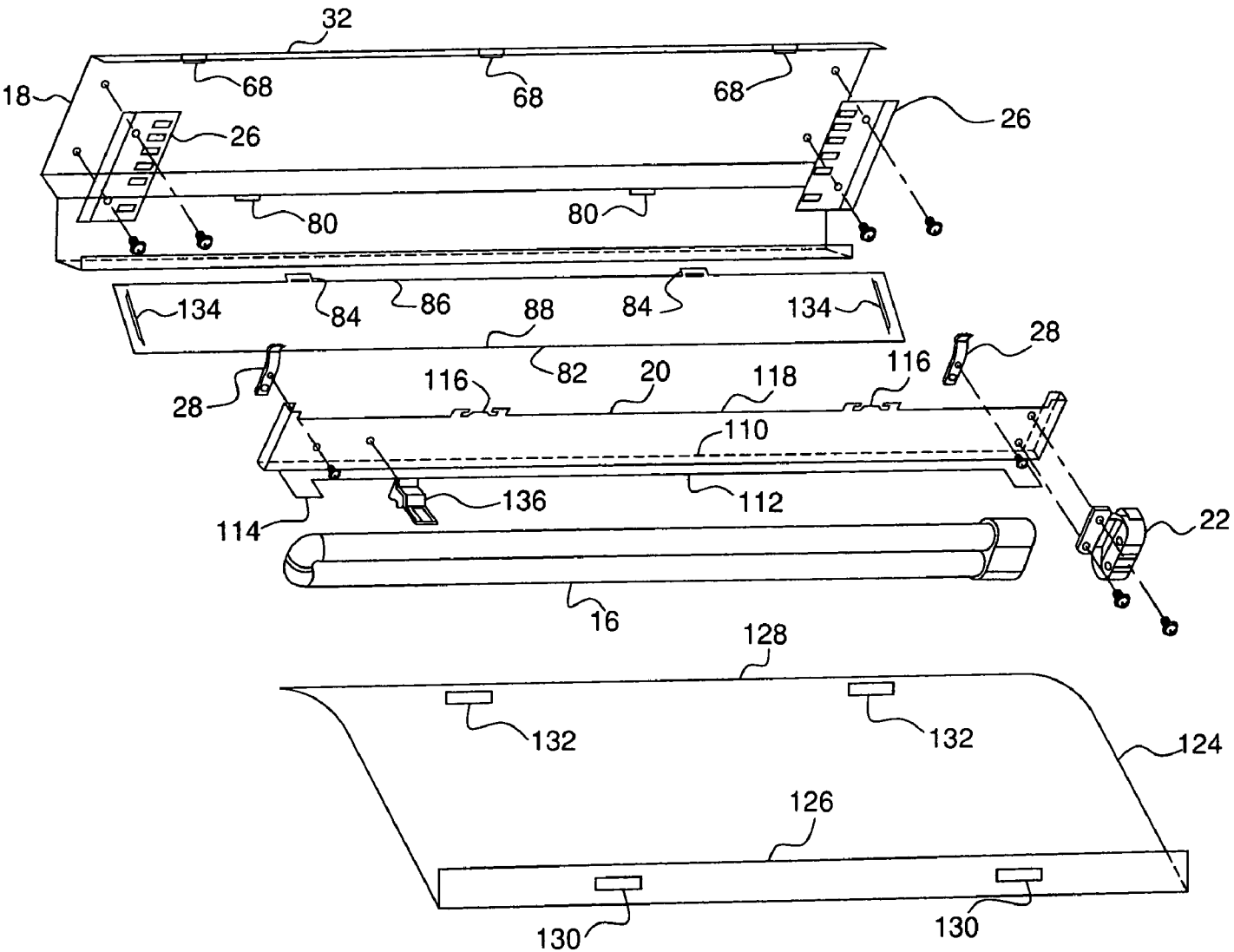
FIG. 5 is an exploded front elevational view of the rear portion of the luminaire shown in FIG. 1.

A second wall 72 of the back housing portion 32 is preferably at a substantially right angle to the inclined base 18, and a vertical wall 74 extends generally vertically. The second wall 72 and the vertical wall 74 are at an approximately 120° angle to one another. A base section 76 extends generally horizontally from the vertical wall 74 and terminates in a lower lip 78. As best seen in FIG. 5, two slots 80 are formed near the intersection of the second plane and the vertical plane. A generally rectangular lower reflector 82 has two tabs 84 extending from the top edge 86 which fit into the two slots 80 in the vertical plane 74. The lower edge 88 of the lower reflector 82 is retained by the lower lip 78 on the base section 76. The reflector has two slots 134 for aligning the side reflectors 94. The lower reflector 82 is preferably constructed of cold-rolled steel that is painted gloss white.

The right hand end cap 34 and the left hand end cap 36 are attached to the left end 90 and right end 92 of the housing 12. The end caps are attached to the front and back housing portions 30, 32 by any suitable means, such as screws. Specular reflectors 94 are located on the internal side of the end caps. The reflectors are preferably constructed of low iridescent specular anodized aluminum.

Figure 6:
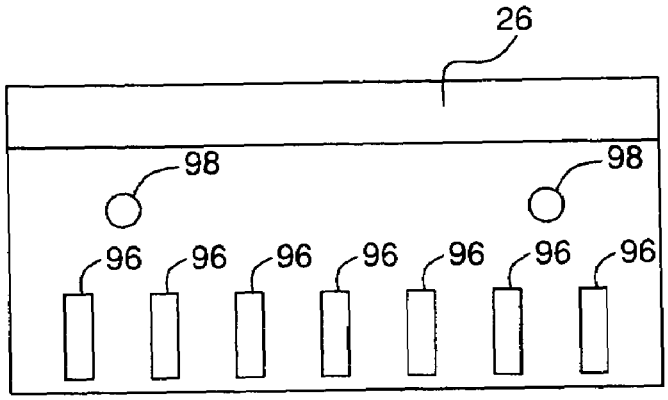
FIG. 6 is a top plan view of the latching plate of the present invention.
Figure 7:
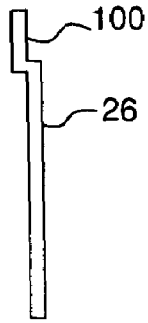
FIG. 7 is a side elevational view of the latching plate shown in FIG. 6.
Figure 11:
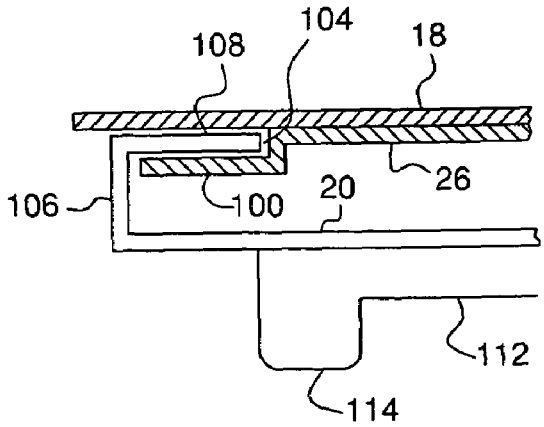
FIG. 11 is an enlarged, sectional view of the connection between the socket pan, the latching plate, and the inclined base.

Each plate 26 of a pair of generally rectangular latching plates has a plurality of adjustment recesses 96 and mounting apertures 98. The adjustment recesses 96 are apertures in the illustrated embodiment; however, they may simply be recessed portions. As seen in FIGS. 6–7, the latching plates 26 are generally flat with an offset portion 100. The plates 26 are mounted to the inclined base 18 by screws that extend through the mounting apertures 98 or by any other suitable fasteners. As shown in FIG. 11, when fastened to the inclined base 18, the offset portion 100 of the latching plate forms a guide channel 104 between the latching plate and the inclined base.

The lamp socket 22 is mounted on the socket pan 20, and is suitably and conventionally electrically connected to the ballast 56. The lamp socket 22 is a standard fluoresecent socket base, such as a 2G11 base. A lamp suppport 136 is provided on the socket pan 20 to support the end of the flourescent lamp 16. As seen most clearly in FIG. 11, each of the longitudinal ends 108 of the socket pan 20 is generally U-shaped with a free arm portion 108. The free arm portion 106 fits into the guide channel 104 formed between the latching plates 26 and the inclined base 18. Returning back to FIG. 5, at the lower edge 110 of the socket pan 20, a lip 112 is formed with two lamp positioning tabs 114. The two lamp positioning tabs 114 may be grasped by a user to move the socket pan 20 along the guide channel 104. Two reflector retaining tabs 116 are located at the top edge 118 of the socket pan 20.

A generally rectangular specular reflector 124 has a first edge 126 and a second edge 128. The first edge 126 of the reflector is bent to form an angle and has two slots 130 located in it. The two slots 130 cooperate with the tabs 48 located on the front wall 40 of the housing 12 to hold the reflector in place. The second edge 128 of the reflector 124 has two retaining slots 132 as well. These retaining slots 132 cooperate with the reflector retaining tabs 116 located on the top edge 118 of the socket pan 20 to fasten the reflector 124 to the socket pan 20. When the socket pan 20 is moved from an upper position to a lower position (or vice versa), the end of the reflector which is attached to the socket pan also moves, thereby changing the relationship between the lamp and the reflector.

Figure 8:
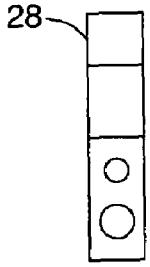
FIG. 8 is a top plan view of a spring detent of the present invention.
Figure 9:
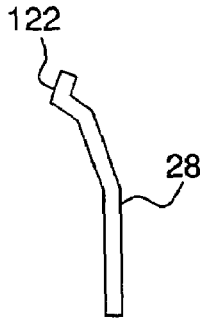
FIG. 9 is a side elevational view of the spring detent shown in FIG. 8.

To hold the socket pan 20 in place in various positions along the inclined base, two retaining springs 28 are provided and are fastened to the housing by screws or any other suitable fasteners. The retaining springs 28, which are illustrated in FIGS. 3 and 8–9, are bent so that they form an extended locking portion 122. The locking portion 122 interacts with a selected one of the series of apertures 96 in latching plate 26 to hold the socket pan 20 in place in various positions along the inclined base 18 as seen in FIGS. 1 and 2.

While various embodiments have been chosen to illustrate the invention, it will be understood by those skilled in the art that various changes and modifications can be made therein without departing from the scope of the invention as defined in the appended claims.

What is claimed is:

1. A fluorescent luminaire, comprising:

a housing with an opening and an inclined base;

a socket pan slidably mounted on the inclined base, the socket pan having a lamp socket for receiving at least one fluorescent lamp;

a latching mechanism attached to the socket pan and the housing, the latching mechanism having a latching plate with a plurality of recesses and a spring detent cooperating with the recesses to selectively fix the position of the socket pan on the inclined base; and a specular reflector having a first edge and a second edge, the first edge being attached to the socket pan and the second edge being attached to the housing.

2. A fluorescent luminaire according to claim 1, wherein the latching plate is fastened to the inclined base; and the spring detent is fastened to the socket pan.

3. A fluorescent luminaire according to claim 2, wherein the socket pan is retained in a guide channel formed between the latching plate and the inclined base.

4. A fluorescent luminaire according to claim 1, further comprising a ballast housing attached to a top wall of the housing; and a ballast located within the ballast housing.

5. A fluorescent luminaire according to claim 1, wherein the recesses in the latching plate are apertures.

6. A fluorescent luminaire according to claim 1, further comprising at least one lamp positioning tab located on the socket pan.

7. A fluorescent luminaire, comprising:

a housing with an opening and an inclined base;

a socket pan slidably mounted on the inclined base, the socket pan having a lamp socket for receiving at least one fluorescent lamp;

means for selectively fixing the position of the socket pan on the inclined base; and a specular reflector having a first edge and a second edge, the first edge being attached to the socket pan and the second edge being attached to the housing.

8. A fluorescent luminaire according to claim 7, wherein the means for selectively fixing the position of the lamp base comprises at least one spring cooperating with recesses in a latching plate.

9. A fluorescent luminaire according to claim 8, wherein the latching plate is attached to the inclined base.

10. A fluorescent luminaire according to claim 9, wherein the at least one spring is fastened to the socket pan.

11. A fluorescent luminaire according to claim 9, wherein the socket pan is retained in a guide channel formed between the latching plate and the inclined base.

12. A fluorescent luminaite according to claim 7, wherein the socket pan has a pair of retaining tabs formed on the top edge; and the first edge of the specular reflector is attached to the retaining tabs on the socket pan.

13. A fluorescent luminaire according to claim 7, further comprising at least one lamp positioning tab located on the socket pan.

14. A fluorescent luminaire, comprising:

a housing with an opening and an inclined base;

a latching plate fastened to the inclined base, the latching plate forming a guide channel between the inclined base and the latching plate;

a socket pan having a lamp socket for receiving at least one fluorescent lamp; the socket pan being slidably retained in the guide channel between the inclined base and the latching plate;

a specular reflector having a first edge and a second edge, the first edge being attached to the socket pan and the second edge being attached to the housing;

a spring detent fastened to the socket pan, the spring detent cooperating with recesses in the latching plate to selectively fix the position of the lamp base on the inclined base.

15. A fluorescent luminaire according to claim 14, further comprising:

a ballast housing attached to a top wall of the housing; and a ballast located within the ballast housing.

16. A fluorescent luminaire according to claim 14, wherein the latching plate has apertures to cooperate with the spring detent.

17. A fluorescent luminaire according to claim 14, further comprising at least one lamp positioning tab located on the socket pan.

18. A fluorescent luminaire according to claim 14, wherein the housing comprises a front portion forming a front wall and top wall;

a rear portion attached to the front portion and forming a rear wall; and end caps attached to the front and rear portion to form end walls.

19. A fluorescent luminaire according to claim 18, wherein the luminaire is a lay-in luminaire for use with ceiling grids.

20. A fluorescent luminaire according to claim 14, wherein the lamp socket is a 2G11 base.

21. A fluorescent luminaire, comprising:

a housing comprising:

a front portion forming a front wall and a top wall;

a rear portion attached to the front portion and forming a rear wall, the rear wall having an inclined base; and end caps attached to the front and rear portion to form end walls;

a latching plate fastened to the inclined base, the latching plate forming a guide channel between the inclined base and the latching plate, the latching plate having a plurality of recesses;

a socket pan having a lamp socket for receiving at least one fluorescent lamp, the socket pan being slidably retained in the guide channel between the inclined base and the latching plate;

a spring detent fastened to the socket pan; the spring detent cooperating with recesses in the latching plate to selectively fix the position of the lamp base on the inclined base.

22. A fluorescent luminaire according to claim 21, further comprising:

a ballast housing attached to a top wall of the housing; and a ballast located within the ballast housing.

23. A fluorescent luminaire according to claim 21, wherein the latching plate has apertures to cooperate with the spring detent.

24. A fluorescent luminaire according to claim 21, further comprising at least one lamp positioning tab located on the socket pan.

25. A fluorescent luminaire according to claim 21, wherein the luminaire is a lay-in luminaire for use with ceiling grids.

26. A fluorescent luminaire according to claim 21, wherein the lamp socket is a 2G11 base.

27. A fluorescent luminaire according to claim 21, further comprising:

a specular reflector having a first edge and a second edge, the first edge being attached to the socket pan and the second edge being attached to the housing.

* * * * *